US007377146B2

(12) United States Patent
Field et al.

(10) Patent No.: US 7,377,146 B2
(45) Date of Patent: May 27, 2008

(54) CYLINDER LOCK WITH AN AXIALLY MOVING SIDEBAR

(76) Inventors: Brandon S. Field, 505 W. High St., Urbana, IL (US) 61801; Tyler H. Field, 505 W. High St., Urbana, IL (US) 61801

( * ) Notice: Subject to any disclaimer, the term of this patent is extended or adjusted under 35 U.S.C. 154(b) by 0 days.

(21) Appl. No.: 11/603,957

(22) Filed: Nov. 22, 2006

(65) Prior Publication Data

US 2007/0137272 A1 Jun. 21, 2007

(51) Int. Cl.
*E05B 29/04* (2006.01)

(52) U.S. Cl. ..... 70/495; 70/409

(58) Field of Classification Search ..... 70/495, 70/496, 409, 491–494, 405–407
See application file for complete search history.

(56) References Cited

U.S. PATENT DOCUMENTS 5,615,566 A 4/1997 Brandt
5,797,287 A 8/1998 Prunbauer
6,477,875 B2 11/2002 Field et al.
6,945,082 B2 9/2005 Field et al.
7,213,429 B2 * 5/2007 Armstrong et al. ..... 70/492
2005/0155399 A1 * 7/2005 Armstrong et al. ..... 70/493
2005/0172687 A1 * 8/2005 Segien et al. ..... 70/493

FOREIGN PATENT DOCUMENTS

DE 2828343 C2 1/1980
WO WO 93/09317 5/1993

* cited by examiner

*Primary Examiner*—Lloyd A. Gall
(74) *Attorney, Agent, or Firm*—Factor & Lake

(57) ABSTRACT

A cylinder lock plug that utilizes an axially moving sidebar. The sidebar is displaced axially by a key positioning mechanism on the blade of a uniquely configured key. Also on the key are unique short grooves on the lateral sides of the key blade running substantially perpendicular to the longitudinal axis of the key blade. The short grooves are configured complementary to an inner surface of the axially moving sidebar. Only the properly configured key can receive the sidebar as the key is turned to rotate the cylinder lock plug and the short grooves receive the inner surface. The invention is meant to be used with additional locking mechanisms, such as, for example, tumblers.

10 Claims, 13 Drawing Sheets

12
42
56
44
62
72
54

42
12
44
50
72
60
64
46
48
58
62
52

CYLINDER LOCK WITH AN AXIALLY MOVING SIDEBAR

BACKGROUND OF THE INVENTION

The present invention relates generally to cylinder locks, and more particularly to cylinder locks that use a complementary configured key and sidebar in conjunction with conventional lock mechanisms, such as tumblers. The sidebar is positioned at a precise axial position by a key positioning mechanism on the key, wherein the sidebar can engage grooves on the side of the key blade. This positioning facilitates the shifting of the sidebar from a locked position to an unlocked position and the key can rotate the cylinder plug.

Cylinder locks for locking doors and other similar structures are well known in the art. Typically these cylinder locks include a cylinder shell, cylinder plug located within the cylinder shell and tumblers extending there through. Further, a locking member, such as a deadbolt, rotates with the cylinder plug to lock or unlock the door, cabinet or other structure.

WO93/09317 (Prunbauer) describes a lock and a key system that utilizes a sidebar mechanism to prevent a cylinder from rotating, but is silent on the axial movement of the sidebar. Further, U.S. Pat. No. 5,797,287 (Prunbauer) is directed to a key, but discloses a system similar to Prunbauer WO093/09317.

German Patent DE2828343, issued to Perkut, discloses yet another key and lock system that uses tumblers to match up with the key ridges and further discloses a ball to use with the sidebar to facilitate rotation. U.S. Pat. No. 5,615,566, issued to Brandt, discloses a lock that has an axially sliding member at the back of the plug, as a secondary locking mechanism, used in conjunction with conventional tumblers.

Further, U.S. Pat. Nos. 6,477,875 and 6,945,082, both issued to Field et al., disclose a lock system that combines an axially sliding member operated by a contact tab integrally formed on a key, to facilitate release of the separate sidebar.

Notwithstanding the prior art, there still remains a need for a lock and key system that, among other things, combines the functions of an axially sliding member and a sidebar. Benefits of such a system include minimizing of moving parts, preferably making lock breakdown less likely, and increasing security of the lock itself.

SUMMARY OF THE INVENTION

In light of these and other benefits, a cylinder lock and a key to position an axially moving sidebar is disclosed herein. The cylinder lock of the present invention, generally, has a cylinder shell, a cylinder plug and a key. Additionally, it is preferred to use the present invention in conjunction with other conventional locking mechanisms, such as tumblers (discussed in detail in the prior art references mentioned above).

A door, cabinet or other structure houses the cylinder shell. The cylinder shell houses a rotatably mounted cylinder plug. The cylinder plug, broadly, has a spring loaded sidebar, a sidebar slot and a key path. The sidebar has a shoulder and an engraved face and is located within the sidebar slot. The sidebar slot has a first sidebar engagement region, a second sidebar engagement region, and a sidebar receiving area.

The sidebar slot extends longitudinally substantially parallel to the key path; the key path being configured to facilitate receiving the proper key.

The key has a key positioning mechanism and short grooves that are both configured complementary to the side bar. The key positioning mechanism cooperates with the side bar positioning mechanism upon insertion of the key into the key path. The short grooves are configured complementary to the engraved face of the side bar to receive said engraved face. A proper key precisely positions the sidebar between the first sidebar engagement region and the second sidebar engagement region, in the sidebar receiving area. At this precise position, the sidebar can be shifted inward and the short grooves can receive the engraved face of the sidebar.

This foregoing description was meant to be general in nature and a more detailed description will explain the invention further. As previously mentioned, this novel cylinder lock and key are meant to be used in conjunction with other conventional locking means well known in the art and described in detail in references such as those previously mentioned.

DETAILED DESCRIPTION OF THE INVENTION

Figure 1:
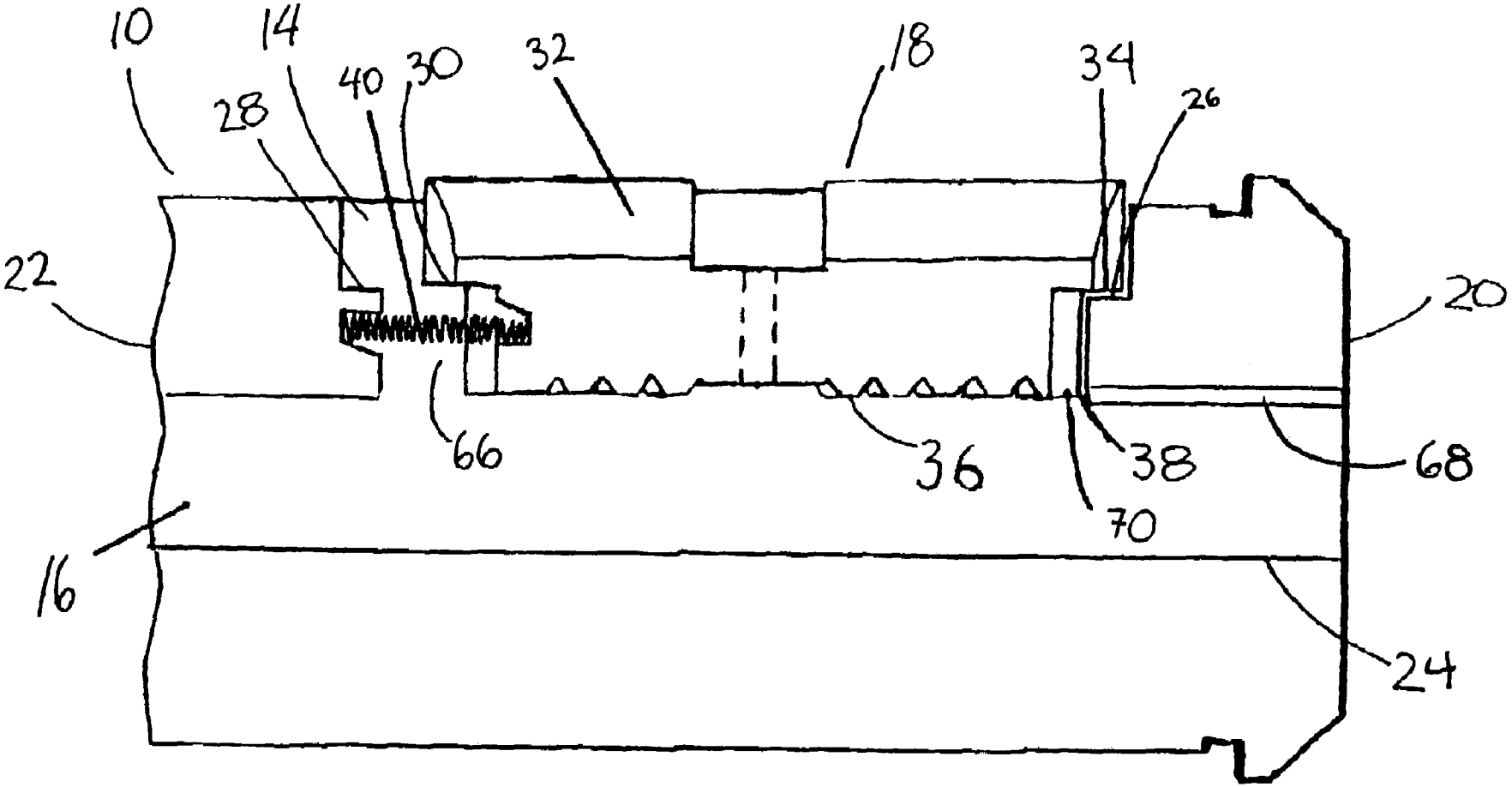
FIG. 1 is a cut away sectional side view of the cylinder plug and an embodiment of an axially displaceable sidebar according to the present invention.

While this invention is susceptible of embodiment in many different forms, there is shown in the drawings and will be described in detail, specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawing by like reference characters. In addition, it will be understood that the drawings are merely representations, and some of the components may have been distorted from actual scale for purposes of pictorial clarity.

Beginning with FIG. 1, a cylinder lock according to the present invention broadly includes a cylinder shell 11, a cylinder plug 10, and a key 12. The cylinder shell 11 is preferably located within a door, cabinet, or other structure. The cylinder shell 11 houses cylinder plug 10. The elements not shown are well known in the art and one of ordinary skill in the art would be able to understand these separate elements and their relation to the present invention. It is preferred, although not required, to construct all of the components out of a metal, for example brass.

The cylinder plug 10 has a sidebar slot 14, key path 16 and a sidebar 18. The cylinder plug 10 further includes a face 20 and a posterior 22. Extending from the face 20 substantially longitudinally throughout the cylinder plug 10 toward the posterior 22 is the key path 16. Located within the key path 16, the cylinder plug 10 has first and second configured faces 24, 68 located on opposite sides of the key path 16. Running relatively parallel to the key path 16 is the sidebar slot 14. The sidebar slot 14 has a first sidebar engagement region 26 located proximate the face 20 and a second sidebar engagement region 28 located proximate the posterior 22. Located between the first and second sidebar engagement regions 26, 28 is the sidebar receiving area 66. Positioned within the sidebar slot 14 is the sidebar 18.

The sidebar 18 has a rear engagement wing 30, a beveled projection edge 32, a front engagement wing 34, an engraved face 36 and a side bar positioning mechanism 38 shown here in the form of a shoulder 70. The sidebar 18 is front-biased, preferably through the utilization of a spring 40, and axially moveable. The rear engagement wing 30 is located proximate the posterior 22 and configured to operate with the second sidebar engagement region 28. The beveled projection edge 32 extends outwardly away from the key path 16 and is received in a notch in the lock shell, not shown but well known in the art. The front engagement wing 34 is located proximate the face 20 and configured to operate with the first sidebar engagement region 26. The engraved face 36 is located on a portion of the sidebar 18 that is exposed to the key path 16. The side bar positioning mechanism 38 extends a distance into the key path 16. Both side bar positioning mechanism 38 and engraved face 36 are configured to correspond with a key 12.

A key 12 has a bow 42 and a blade 44. The blade 44 has a front tip 46 and a base 48. The blade 44 also can have a flat edge 50 located opposite a bitted edge 52 and a grooved face 54 located opposite a channeled face 56. Not shown, but known in the art, is a key blade that has both edges bitted. As is well known in the art, the channeled face 56 contains a pattern of longitudinally running channels 58 which can be configured to correspond with the first configured face 24 of the key path 16 and the grooved face can be configured to correspond with the second configured face 68 of the key path 16.

The grooved face 54 of the key 12 contains short grooves 60 and a key positioning mechanism 62 shown here as a contact tab 72. The short grooves 60 run substantially perpendicular to the horizontal axis of the key B-B, but can also be at one or more unique predetermined angle 64 for each lock and key system. The short grooves 60 are configured to correspond to the engraved face 36 of the sidebar 18.

The key positioning mechanism 62 may be located on the grooved face 54 of the key 12. Alternatively contemplated, but not shown in this embodiment, is a key positioning mechanism 62 located on the channel face 56 of the key 12. The key positioning mechanism 62 is configured complementary to the sidebar positioning mechanism 38. The relationship of the key positioning mechanism 62 to the location of the short grooves 60 is configured complementary to the relationship of the sidebar positioning mechanism 38 to the engraved face 36 of the sidebar 18.

Figures 2, 3:
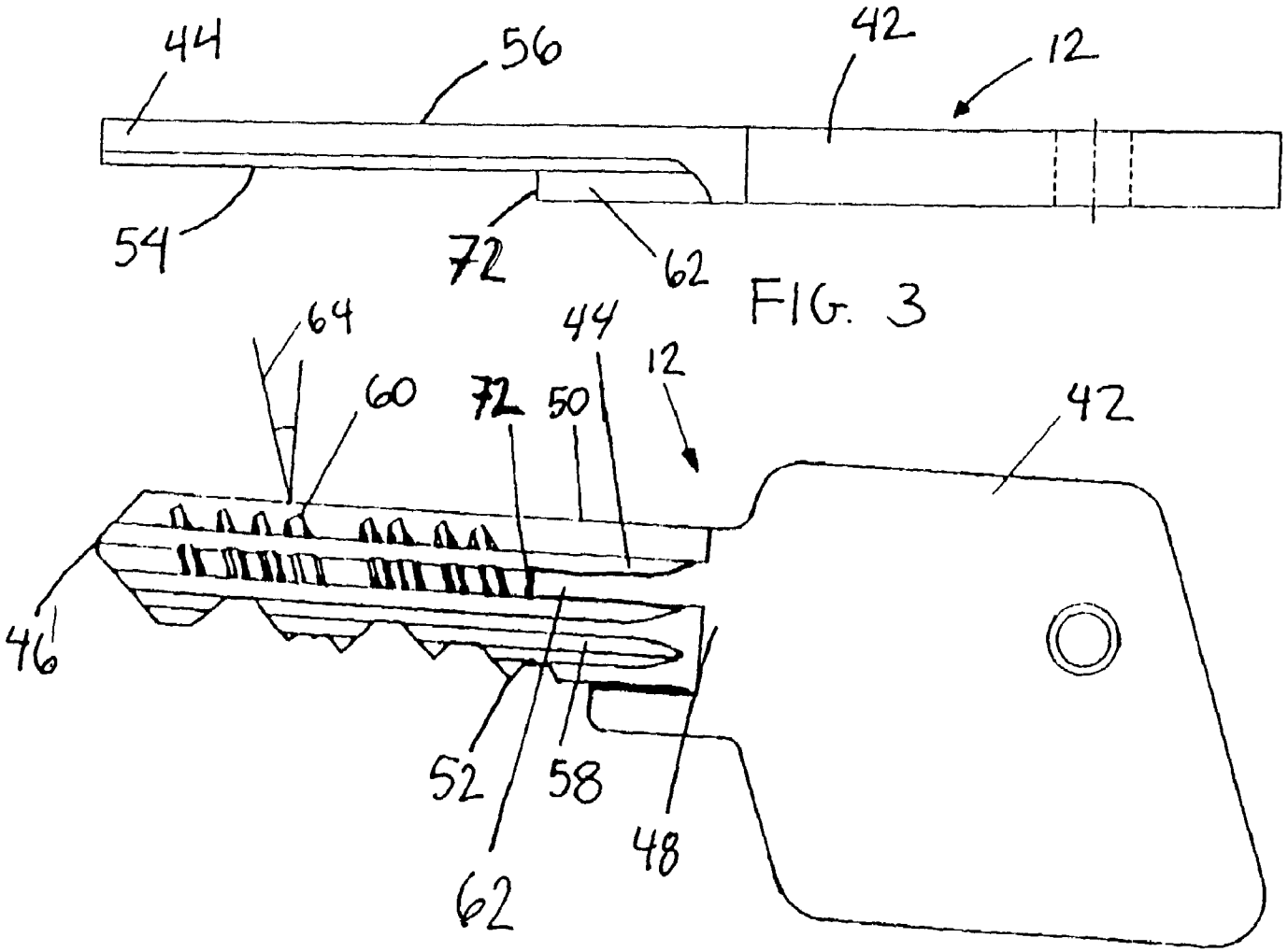
FIG. 2 is a side view of an embodiment of a key corresponding to a sidebar according to the present invention.
FIG. 3 is a bottom view of an embodiment of a key corresponding to a sidebar according to the present invention.

There are many different embodiments of the key positioning mechanism 62 and sidebar positioning mechanism 38. In a first embodiment of FIGS. 1 and 2, the key positioning mechanism 62 may be a contact tab 72 which extends outward a distance on the blade 44 from the base 48 to a distance shorter than the length of the entire blade 44. The sidebar positioning mechanism 38 for this embodiment is the shoulder 62.

Figure 8:
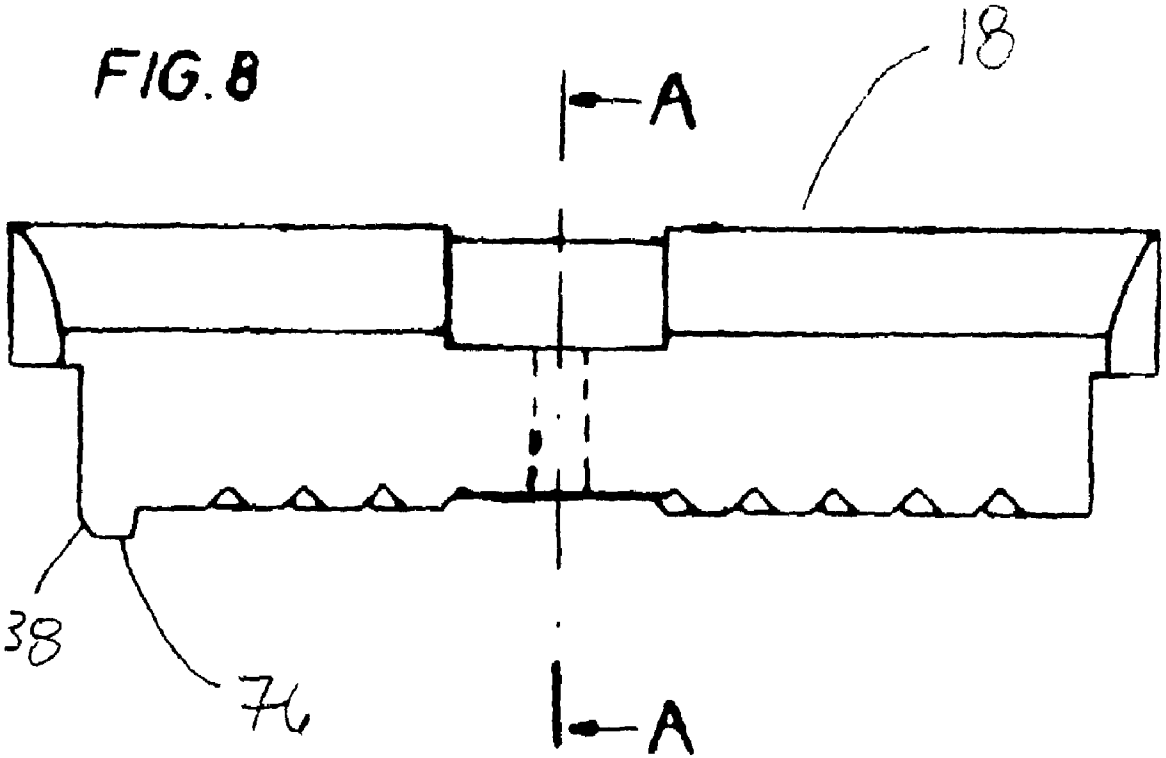
FIG. 8 is a side view of an alternative embodiment of a sidebar according to the present invention.
Figure 8A:
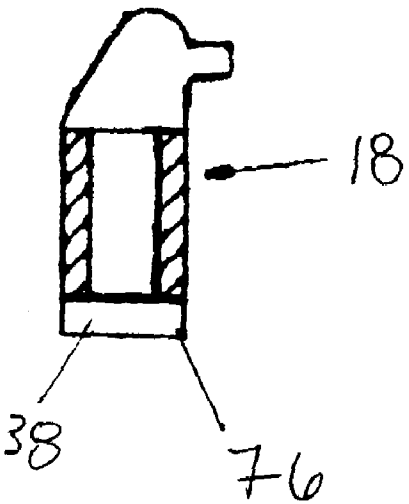
FIG. 8A is a sectional view from line A-A in FIG. 8.
Figure 12:
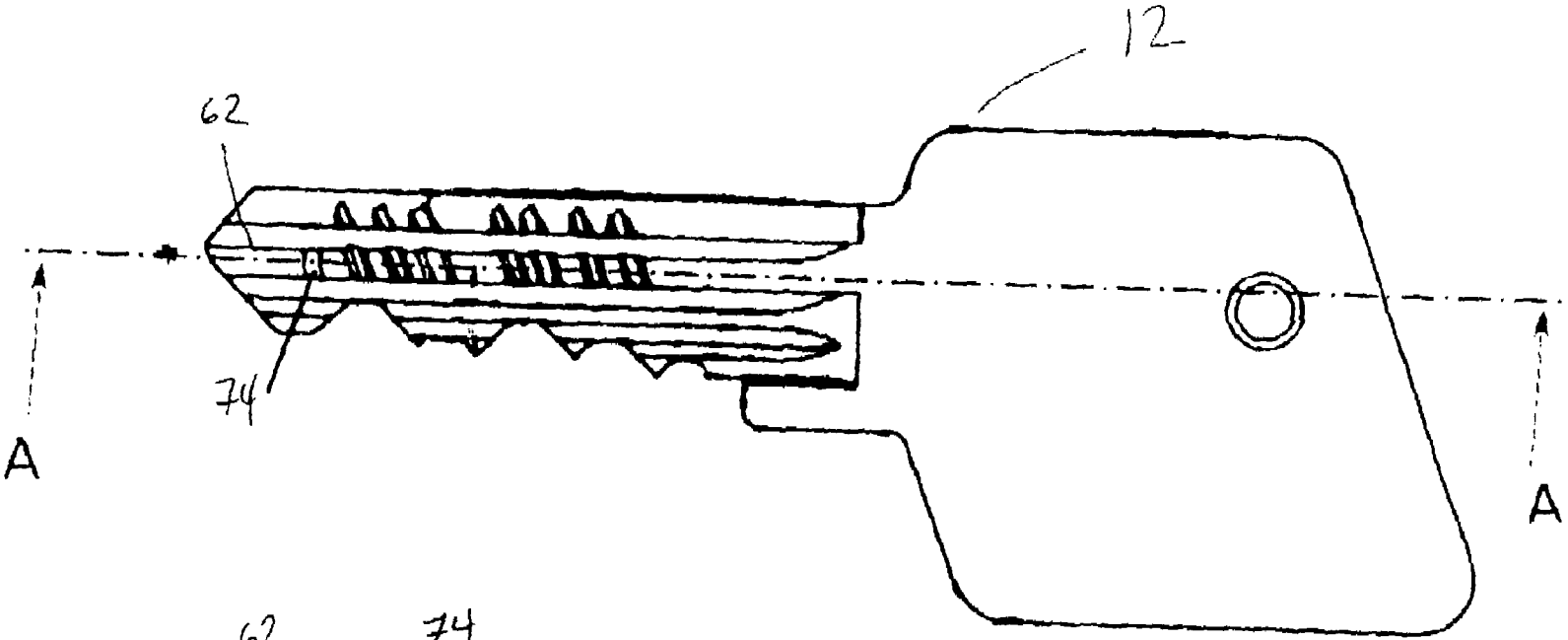
FIG. 12 is a side view of an alternative embodiment of a key according to the present invention.
Figure 12A:
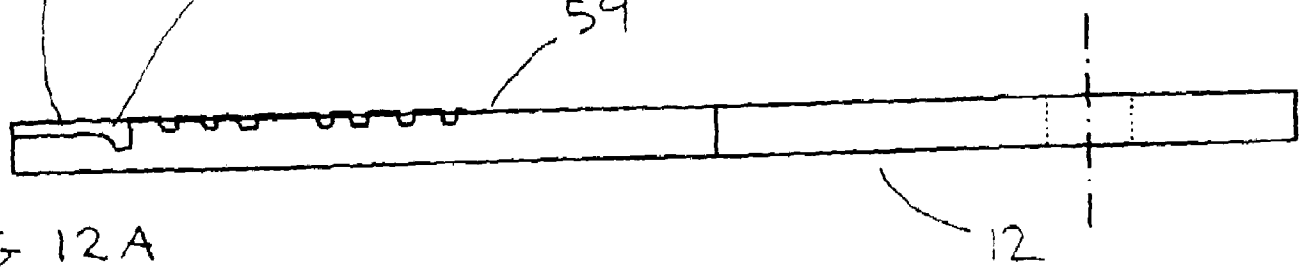
FIG. 12A is a bottom view from line A-A in FIG. 12.

In a second embodiment shown in FIGS. 8 and 12, the key positioning mechanism 62 is a channel 74, which is shown, but not limited to, as being milled into the grooved face 54 of the key 12. The side bar positioning mechanism 38 in this embodiment is a foot 76. The channel 74 engages with the foot 76 towards the rear of the side bar 18 that may extend beyond the engraved face 36.

Figure 9:
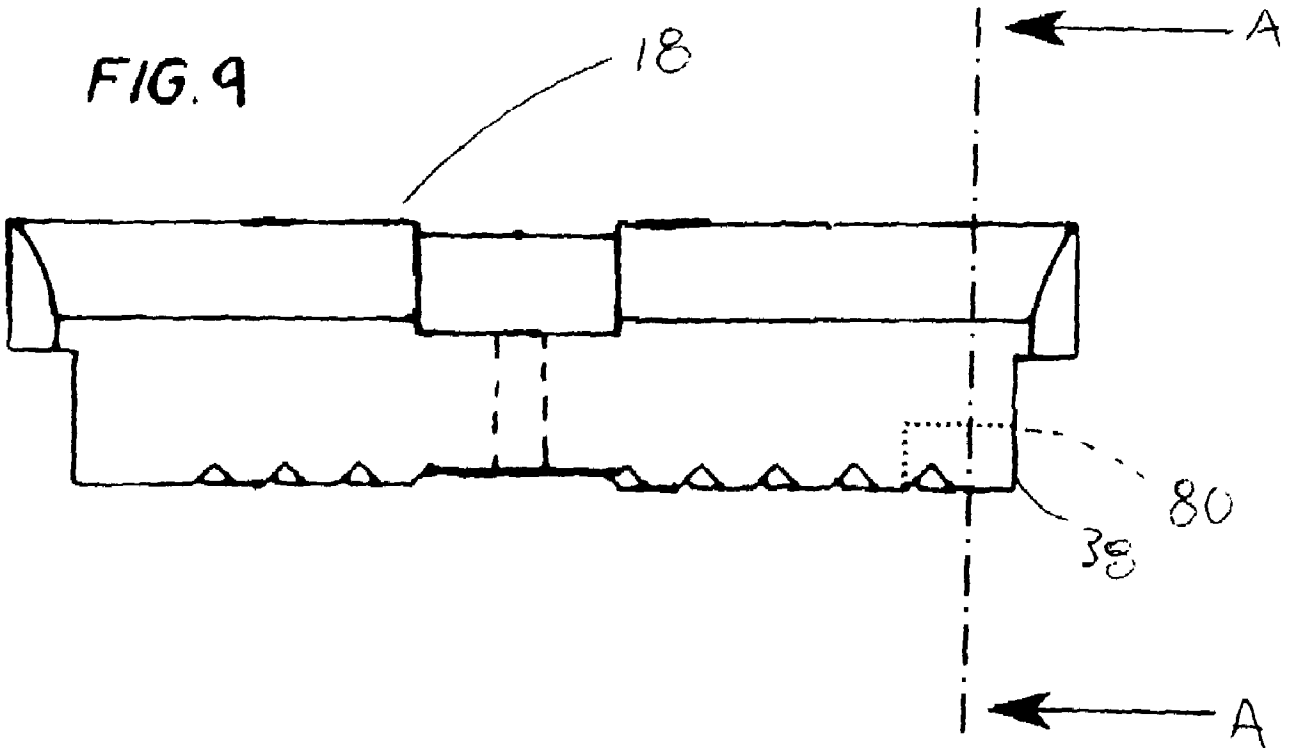
FIG. 9 is a side view of an alternative embodiment of a sidebar according to the present invention.
Figure 9A:
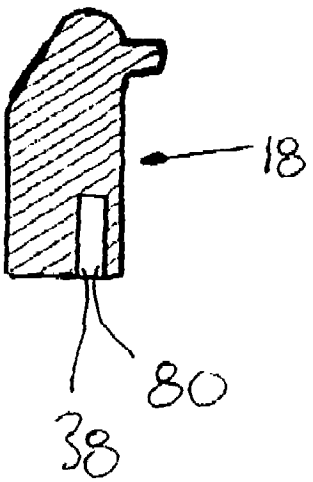
FIG. 9A is a sectional view from line A-A in FIG. 9.
Figure 13:
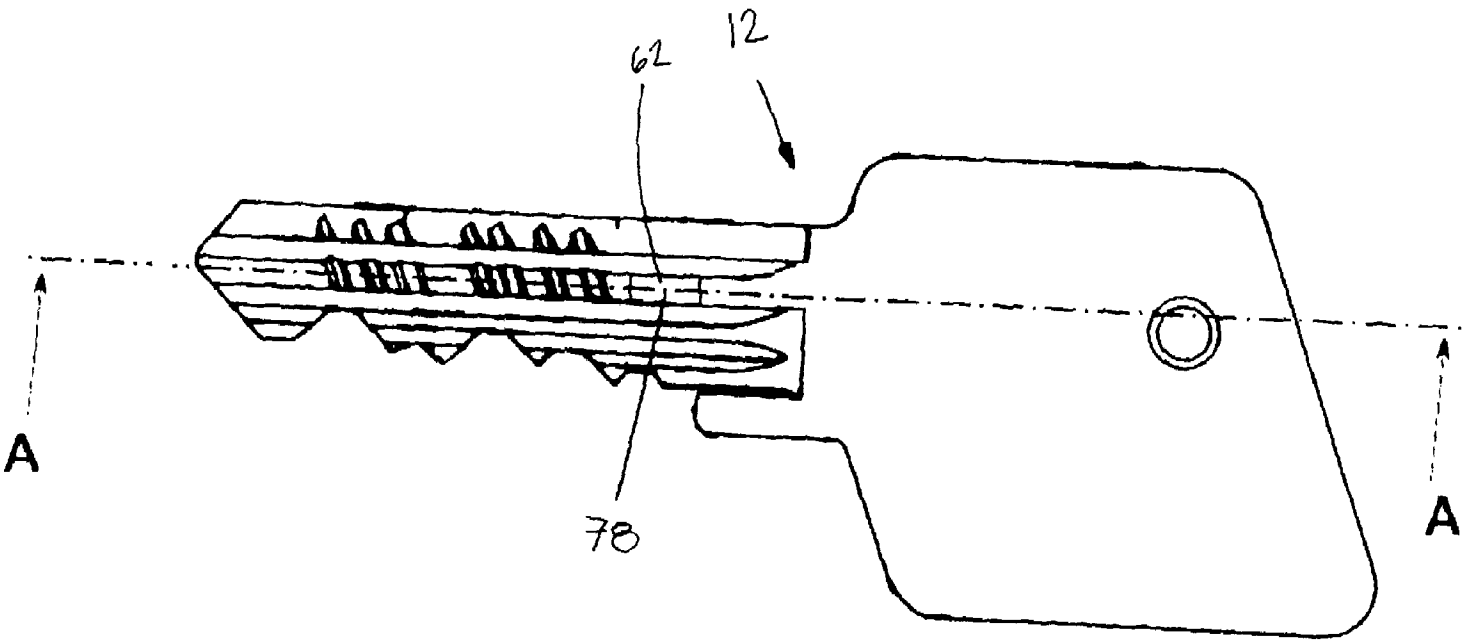
FIG. 13 is a side view of an alternative embodiment of a key according to the present invention.
Figure 13A:
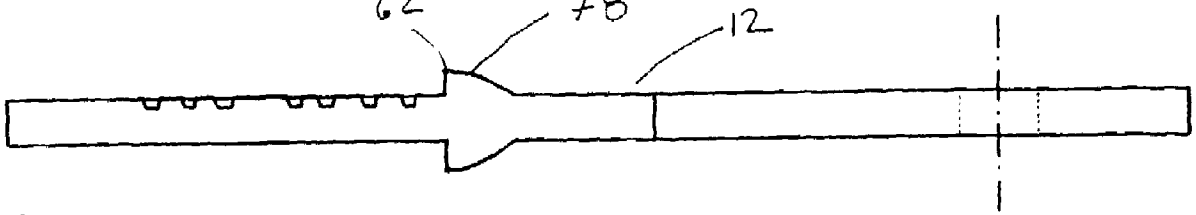
FIG. 13A is a bottom view from line A-A in FIG. 13.

In a third embodiment shown in FIGS. 9 and 13, the key positioning mechanism 62 is a second contact tab 78 extending outward a distance from the grooved face 54. It is also contemplated that the second contact tab 78 extends outward a distance from the channeled face 56. Additionally, it is further contemplated to utilize the second contact tab 78 on both faces of the key 12. The second contact tab 78 engages with the sidebar positioning mechanism, 38, which in this embodiment comprises a notch 80 in the sidebar 18.

Figure 10:
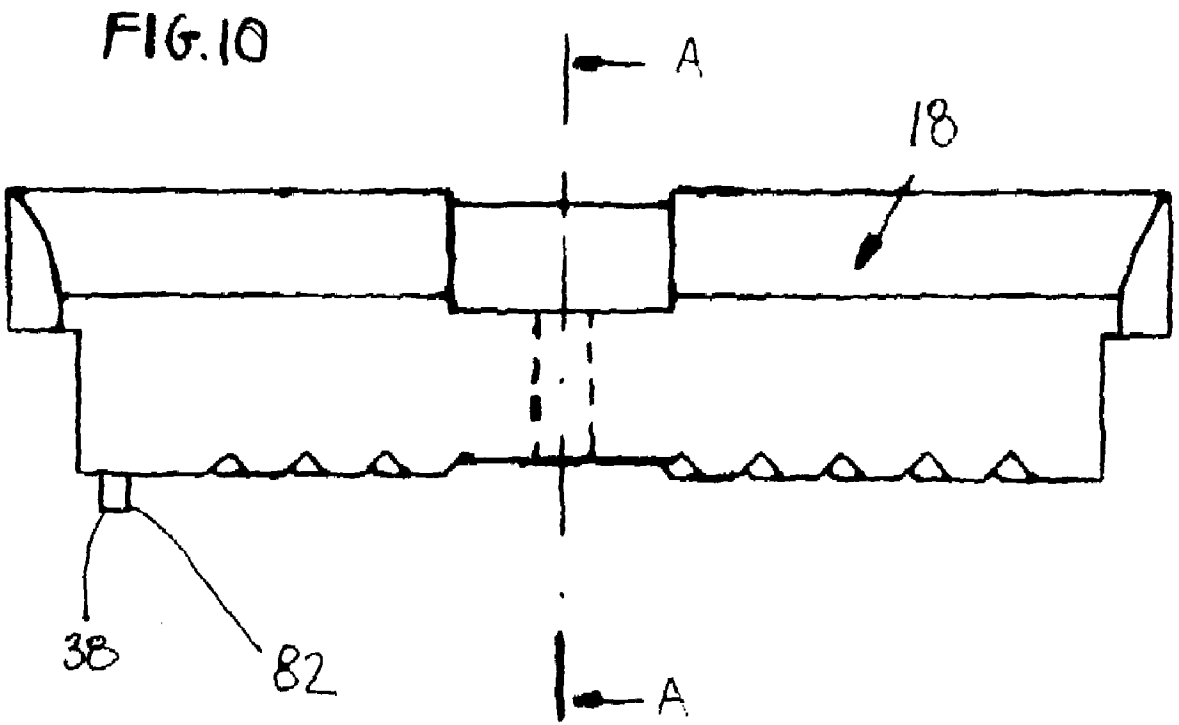
FIG. 10 is a side view of an alternative embodiment of a sidebar according to the present invention.
Figure 10A:
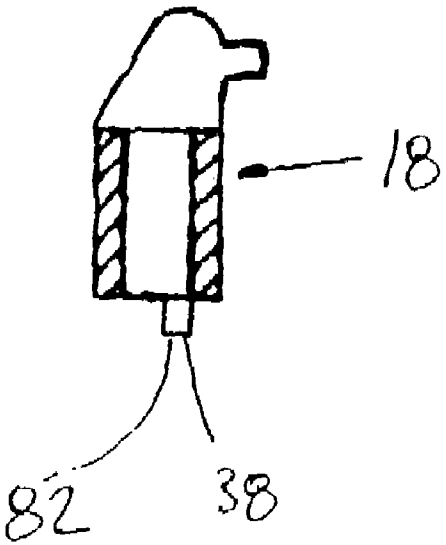
FIG. 10A is a sectional view from line A-A in FIG. 10.
Figure 14:
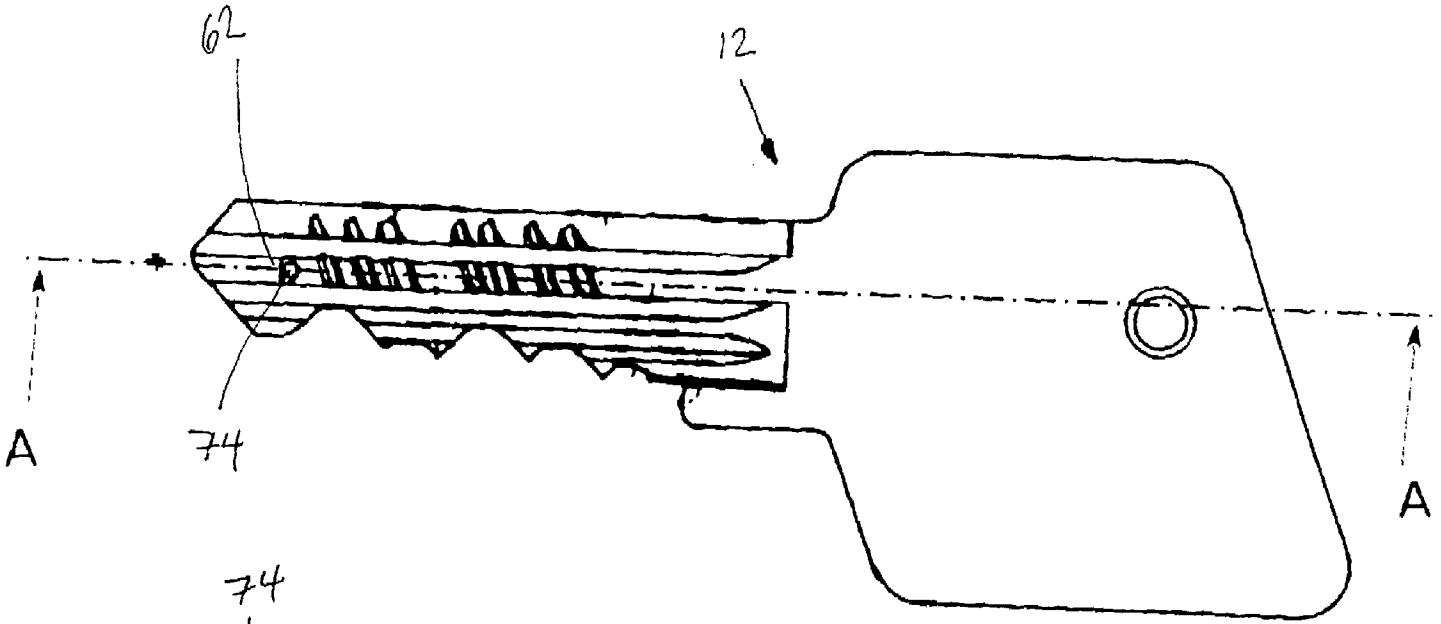
FIG. 14 is a side view of an alternative embodiment of a key according to the present invention.
Figure 14A:
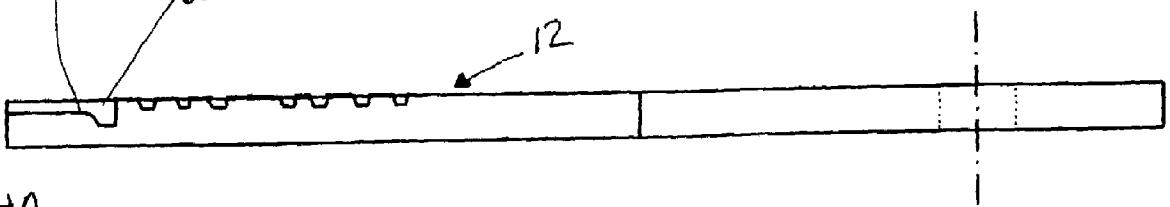
FIG. 14A is a bottom view from line A-A in FIG. 14.

In a fourth embodiment shown in FIGS. 10 and 14, the key positioning mechanism 62 may be the channel 74 in the grooved face 54, but the sidebar positioning mechanism is a peg 82 that extends away from the sidebar 18 into the key path 16.

Figure 11:
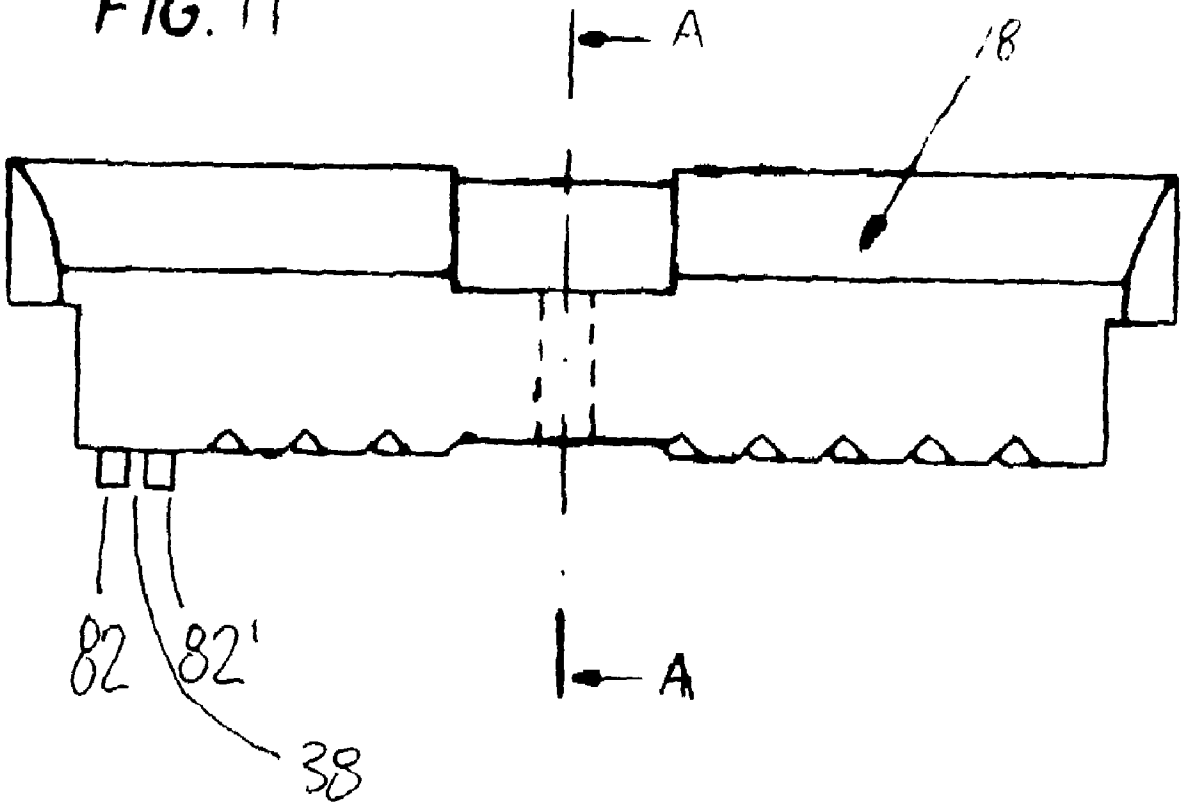
FIG. 11 is a side view of an alternative embodiment of a sidebar according to the present invention.
Figure 11A:
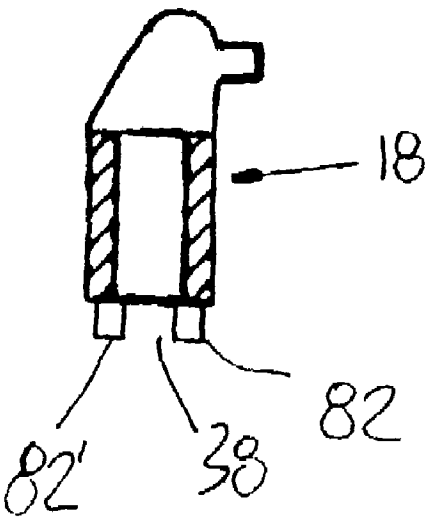
FIG. 11A is a sectional view from line A-A in FIG. 11.
Figure 15:
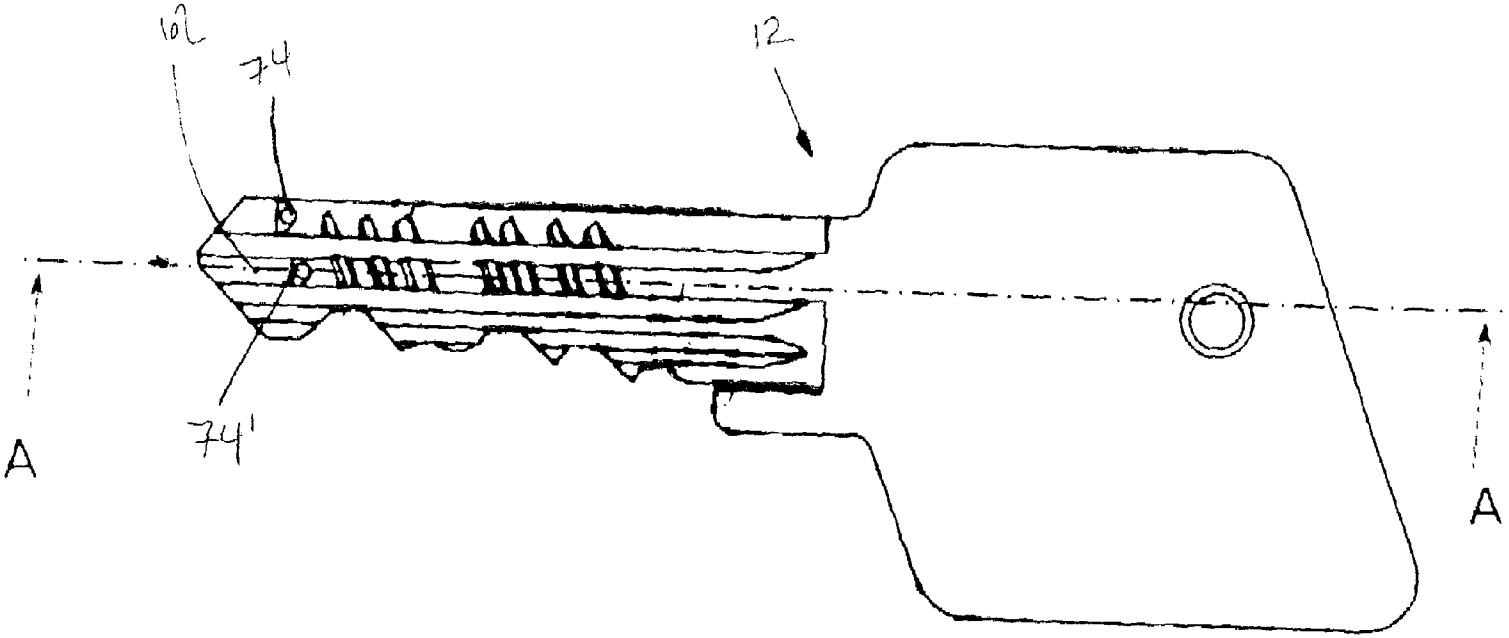
FIG. 15 is a side view of an alternative embodiment of a key according to the present invention.
Figure 15A:
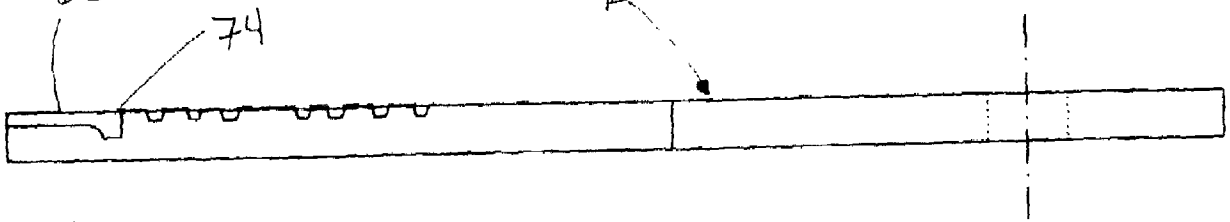
FIG. 15A is a bottom view from line A-A in FIG. 15.

In a fifth embodiment shown in FIGS. 11 and 15, the key positioning mechanism 62 may be multiple channels 74, 74' in the grooved face 54, and the sidebar positioning mechanism may be multiple pegs 82, 82' extending away from the sidebar 18 into the key path 16. The pegs 82, 82' must be precisely aligned vertically and axially with the multiple channels 74, 74' in the grooved face 54. One or more of these multiple pegs 82, 82' can be configured to allow for multiple layers of masterkeying.

The bitted edge 52 of the blade 44 is meant to operate with conventional tumblers, well known in the art but not shown in the drawings. Also contemplated, but not shown, is the use of a second sidebar having a second sidebar positioning mechanism, a second set of short grooves and a second key positioning mechanism. This would even further increase the security measures of the novel cylinder lock and key blank. The novel cylinder lock will now be described in operation in conjunction with the novel key blank.

In preferable operation, the present invention operates to prevent rotation of the cylinder plug 10 when an improperly configured key 12 is inserted into the key path 16 of the cylinder plug 10. When a properly configured key 12 is inserted into the key path 16, the cylinder lock plug 10 can be rotated to disengage a functionally attached deadbolt, or other similar structure well known in the art.

The front tip 46 of the blade 44 of the key 12 can be inserted into the key path 16. As previously stated, only a key 12 with a channeled face 56 configured to correspond to the first configured face 24 of the key path 16 and a grooved face 54 configured to correspond to the second configured face 68 of the key path 16 can be inserted; while, improper keys will be precluded from entering the key path 16.

Prior to insertion of the key 12, the sidebar 18 sits in a locked position. (FIG. 1). In the locked position, the first sidebar engagement region 26 blocks the sidebar 18 from moving inward by contacting the front engagement wing 34. As the blade 44 slides axially to the posterior 22 of the cylinder plug 10, at a predetermined distance the key positioning mechanism 62 will engage the sidebar positioning mechanism 38. As the blade 44 continues sliding further in the same direction, the sidebar 18 can move correspondingly because of the cooperation between the key positioning mechanism 62 and the sidebar positioning mechanism 38.

Figure 4:
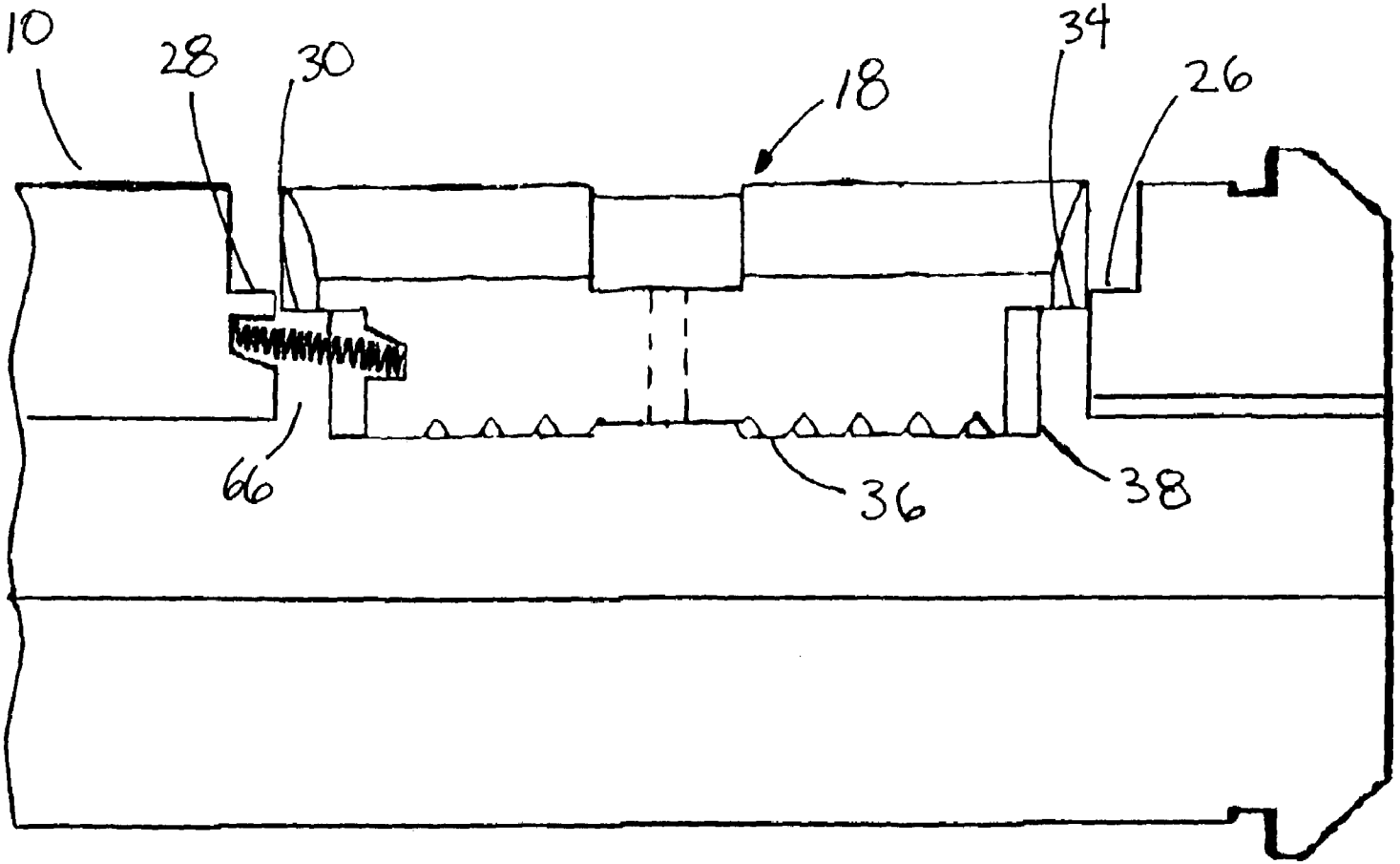
FIG. 4 is a cut away side view of the cylinder plug and an embodiment of an axially displaceable sidebar according to the present invention, wherein the axially moving sidebar has been precisely positioned in the sidebar receiving area.
Figure 5:
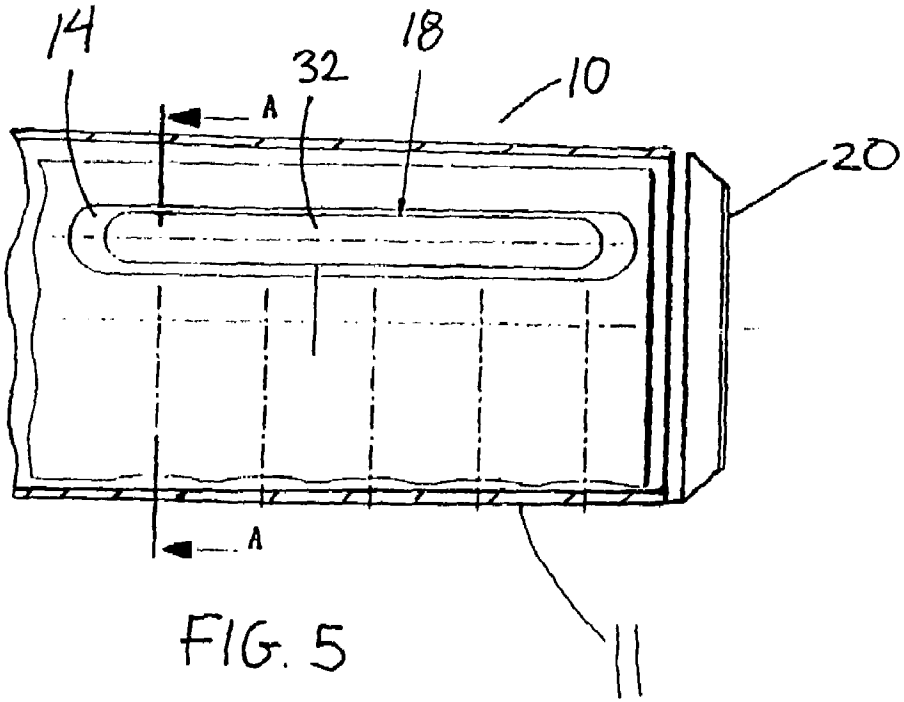
FIG. 5 is a side view of a cylinder plug.
Figure 6:
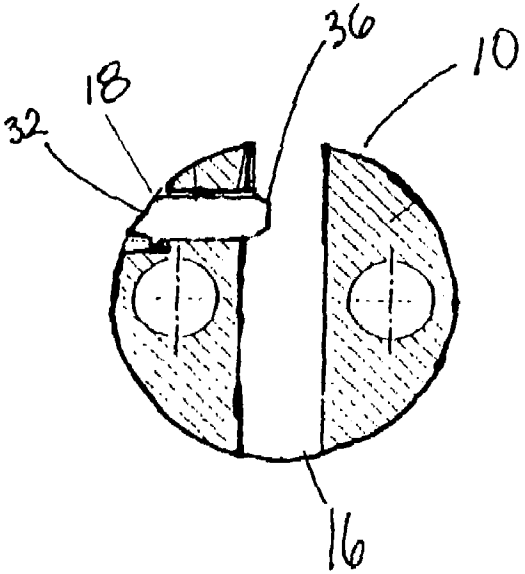
FIG. 6 is a sectional view from line A-A in FIG. 5.
Figure 7:
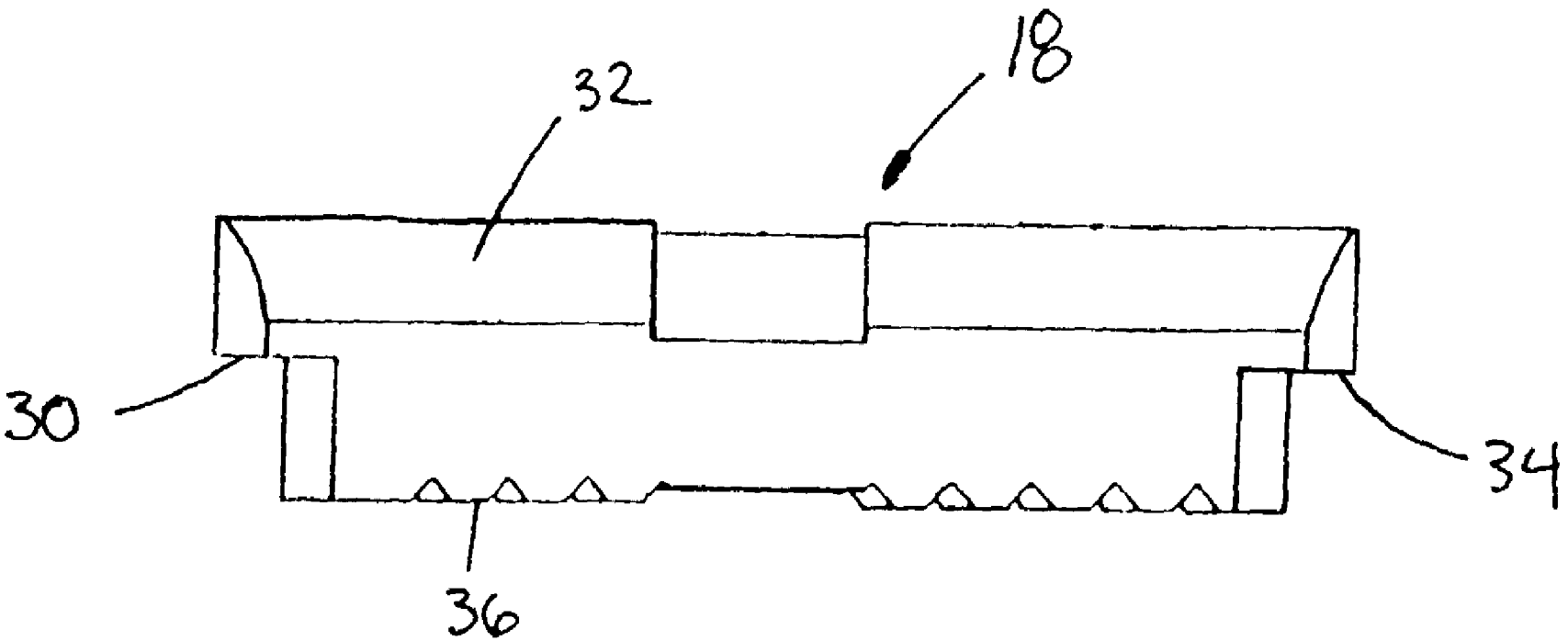
FIG. 7 is a side view of an embodiment of the sidebar.

At a precise distance when the proper key 12 is fully inserted, the key positioning mechanism 62 will have pushed/forced the sidebar 18 into the precise location (see FIG. 4) for enabling rotation of the key 12, and, in turn, locking or unlocking the cylinder plug 10. At this precise distance the front engagement wing 34 can clear the first sidebar engagement region 26 and the rear engagement wing 30 can clear the second sidebar engagement region 28. (FIG. 4). As a result of this precise axial positioning, the sidebar 18 will be able to shift inward to, in turn, enable operative engagement with the key 12.

If a key 12 with an improper key positioning mechanism 62 is inserted, the sidebar 18 cannot be moved the precise distance. If the key positioning mechanism 62 is too far forward or if it is located at the improper location vertically to engage with the sidebar positioning mechanism 38, the sidebar 18 will not be precisely positioned in the sidebar receiving area 66 because the front engagement wing 34 cannot clear the first sidebar engagement region 26. On the other hand, if the key positioning mechanism 62 is too far to the rear, the sidebar 18 will be pushed too far toward the posterior 22 of the cylinder plug 10 causing the rear engagement wing 30 to become blocked/obstructed by the second sidebar engagement region 28. Both of these scenarios will prevent the sidebar 18 from shifting inward toward the key blade 44.

However, if a key 12 with a proper key positioning mechanism 62 is inserted, the sidebar 18 will be forced a precise and operative axial position within the cylinder plug 10. (see FIG. 4). At this precise axial distance, the sidebar 18 can be shifted inward toward the key blade 44. This inward shifting is typically achieved though cooperation of the beveled projection edge 32 and the notch. As the key bow 42 is turned, the cylinder plug 10 can rotate as well, in turn, rotating the sidebar 18 in the sidebar slot 14 of the cylinder plug 10. At this point, the notch operates with the beveled projection edge 32 to shift the sidebar 18 inward toward the blade 44.

As the sidebar 18 shifts inward toward the blade 44, the engraved face 36 can abut the short grooves 60. A blade 44 with short grooves 60 configured complementary to the engraved face 36 can receive the engraved face 36, and the sidebar 18 can fully shift inward, allowing rotation of the cylinder plug 10, and, in turn, the locking or unlocking of the door as described above. If the blade 44 has short grooves 60 that are not configured complementary to the engraved face 36, the sidebar 18 can be prevented from shifting inward, thus preventing the rotation of the cylinder plug 10.

As previously mentioned, this locking system is meant to be incorporated into a cylinder lock which incorporates standard and conventional locking elements, such, for example, tumblers which engage the bitted edge 52 of the blade 44 and the description has been limited to those novel elements of the present invention.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A cylinder lock and key system, the system compnsing:

a key having a key positioning mechanism and a short groove, and, a cylinder lock comprising:

a shell;

a plug rotatably mounted within the shell, wherein the plug houses an axially displaceable sidebar, the sidebar including an engraved face and a positioning mechanism, wherein the engraved face has a configuration complementary to the short groove of the key, and, the positioning mechanism having a configuration complementary to the configuration of the key positioning mechanism such that when the key is inserted into the plug, the key positioning mechanism contacts the sidebar positioning mechanism and axially positions the sidebar to facilitate rotation of the plug.

2. The system of claim 1 wherein the sidebar positioning mechanism comprises a shoulder.

3. The system of claim 1 wherein the sidebar positioning mechanism comprises a foot.

4. The system of claim 1 wherein the sidebar positioning mechanism comprises a notch.

5. The system of claim 1 wherein the sidebar positioning mechanism comprises a peg.

6. The system of claim 1 wherein the sidebar positioning mechanism comprises a shoulder and the key positioning mechanism comprises a contact tab.

7. The system of claim 1 wherein the sidebar positioning mechanism comprises a channel and the key positioning mechanism comprises a foot.

8. The system of claim 1 wherein the sidebar positioning mechanism comprises a contact tab and the key positioning mechanism comprises a notch.

9. The system of claim 1 wherein the sidebar positioning mechanism comprises a channel and the key positioning mechanism comprises a peg.

10. The system of claim 1 wherein the sidebar positioning mechanism comprises a plurality of channels and the key positioning mechanism comprises a plurality of pegs, each channel configured complementary to a peg from the plurality of pegs.

* * * * *